US006131519A

United States Patent [19]

Thiesen et al.

[11] Patent Number: 6,131,519

[45] Date of Patent: Oct. 17, 2000

[54] PROPELLANT CASE FOR AN AMMUNITION CARTRIDGE

[75] Inventors: Stefan Thiesen, Willich; Dieter Jungbluth, Herschbach, both of Germany

[73] Assignee: Rheinmetall W & M GmbH, Unterlüss, Germany

[21] Appl. No.: 09/196,189

[22] Filed: Nov. 20, 1998

[30] Foreign Application Priority Data

Nov. 22, 1997 [DE] Germany ..... 197 51 933

[51] Int. Cl.[7] ..... F42B 5/26

[52] U.S. Cl. ..... 102/469

[58] Field of Search ..... 102/469, 470, 102/430, 431, 432, 433, 434, 700, 466, 467, 439

[56] References Cited

U.S. PATENT DOCUMENTS

| | | | |
|---|---|---|---|
| 2,818,021 | 12/1957 | Boehm et al. | 102/469 |
| 4,159,678 | 7/1979 | Luther et al. . | |
| 5,325,785 | 7/1994 | Gardner | 102/430 |
| 5,563,365 | 10/1996 | Dineen et al. | 102/431 |

FOREIGN PATENT DOCUMENTS

| | | | |
|---|---|---|---|
| 2264267 | 10/1975 | France | 102/469 |
| 123183 | 9/1901 | Germany . | |
| 338034 | 9/1936 | Italy | 102/469 |
| 511595 | 10/1958 | Italy | 102/469 |
| 1036 | 2/1883 | United Kingdom . | |

*Primary Examiner*—Thomas Price
*Attorney, Agent, or Firm*—Venable; Gabor J. Kelemen

[57] ABSTRACT

A propellant case includes a case sleeve having a longitudinal axis; a case bottom including a case bottom base; and an axially extending case bottom dome having a socket for supporting a primer therein. The case bottom base is releasably attached to the case bottom dome, while the case bottom dome is permanently attached to the case sleeve, whereby upon removing the case bottom from the case bottom dome, a connection between the case bottom dome and the case sleeve is preserved.

5 Claims, 1 Drawing Sheet

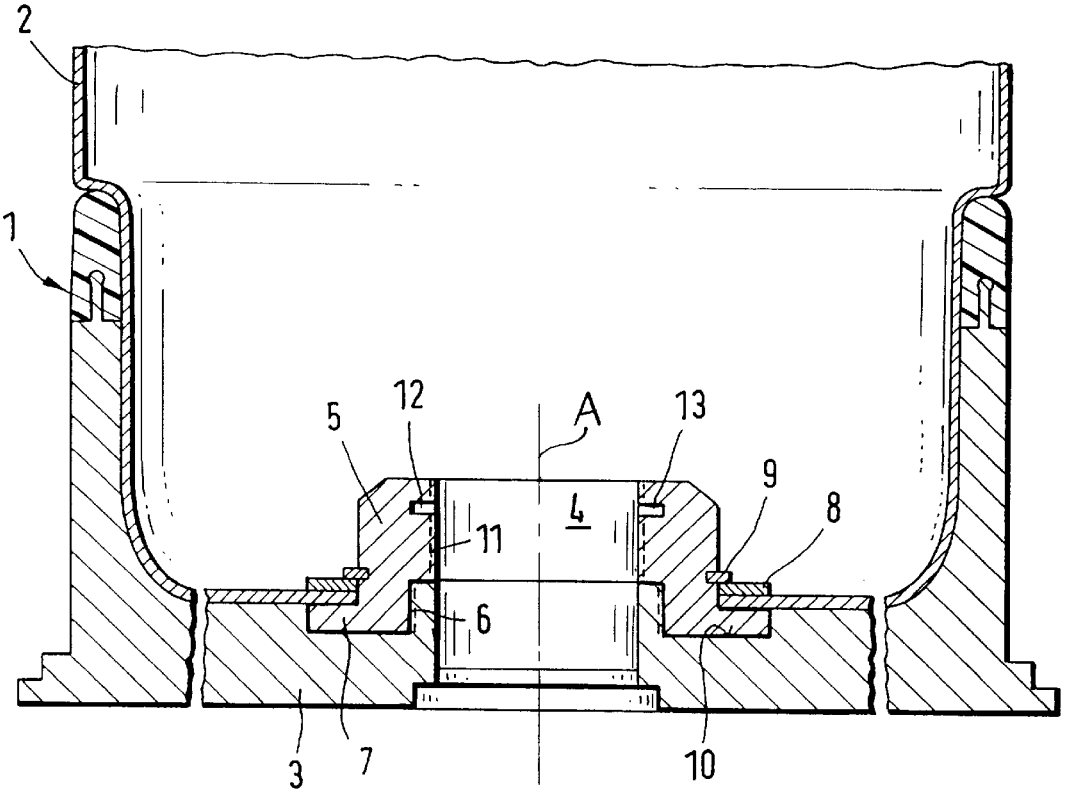
2
1
5
12
A
13
9
8
4
11
6
3
7
10

PROPELLANT CASE FOR AN AMMUNITION CARTRIDGE

CROSS REFERENCE TO RELATED APPLICATION

This application claims the priority of German Application No. 197 51 933.4 filed Nov. 22, 1997, which is incorporated herein by reference.

BACKGROUND OF THE INVENTION

This invention relates to a propellant case composed of a case sleeve and a case bottom and forming part of a cartridge ammunition.

U.S. Pat. No. 4,159,678 discloses a propellant case which includes a case bottom having a case bottom base and a case bottom dome extending axially into the propellant case and being provided with a support for a threaded primer. The case bottom dome is unremovably connected with the case bottom base. For securing the case sleeve to the case bottom, in the known propellant case an annular flat spring steel member is provided which is disposed concentrically around the case bottom dome and which presses the case sleeve against the case bottom base. The spring steel member is held in place by a securing ring mounted on the case bottom dome.

It is, among others, a disadvantage of the above-outlined known propellant case that a replacement of the case bottom is possible only by disassembling the entire ammunition cartridge. Since in current large-caliber cartridge ammunition more and more frequently case bottoms are used which hold electronic components such as sensors (for example, temperature sensors) or micro control devices, it is expedient to develop cartridges in which the base bottom is replaceable so that, if required, even conventional cartridges may be converted in a simple manner into cartridges which have electronic components in the case bottom.

SUMMARY OF THE INVENTION

It is an object of the invention to provide an improved propellant case whose case bottom may be replaced in a simple manner without disassembling the entire cartridge.

This object and others to become apparent as the specification progresses, are accomplished by the invention, according to which, briefly stated, the propellant case includes a case sleeve having a longitudinal axis; a case bottom including a case bottom base; and an axially extending case bottom dome having a socket for supporting a primer therein. The case bottom base is releasably attached to the case bottom dome, while the case bottom dome is permanently attached to the case sleeve, whereby upon removing the case bottom from the case bottom dome, a connection between the case bottom dome and the case sleeve is preserved.

In essence, according to the invention, the case bottom base and the case bottom dome are releasably coupled to one another, preferably by a threaded connection, so that when the case bottom base is removed from the case bottom dome, the case sleeve remains attached to the case bottom dome.

The case bottom dome is provided with holding devices, preferably at least two fixing bores extending radially from the primer-holding socket for receiving a suitable tool which holds the case bottom dome while the case bottom base is released from or attached to the case bottom dome.

According to a preferred embodiment of the invention, the case bottom dome has on its side a laterally projecting collar oriented towards the case bottom base, so that the case sleeve may be secured between the collar and a flat sheet metal spring attached to the case bottom dome by means of a securing ring.

BRIEF DESCRIPTION OF THE DRAWING

The sole FIGURE is an axial sectional view of the region of the case bottom of a cartridge ammunition, illustrating a preferred embodiment.

DESCRIPTION OF THE PREFERRED EMBODIMENT

The Figure shows a case bottom 1 having a case bottom base 3. The Figure further illustrates a case sleeve 2 which has a longitudinal axis A and whose rearward (lower) terminal length portion is surrounded by the lateral wall of the case bottom 1. The components form part of a large-caliber cartridge fired, for example, from tank cannons. The case bottom 1 further receives a case bottom dome 5 which extends axially inwardly and which includes a threaded socket 4 for threadedly receiving an externally threaded primer (not shown). The case bottom dome 5 is releasably coupled with the case bottom base 3 by means of a screw connection 6 having a left-hand thread.

The case bottom dome 5 has, on its side oriented towards the case bottom base 3, a laterally projecting collar 7 against which the radially inwardly extending terminal part of the case sleeve 2 is pressed by means of a conventional flat spring member 8, as disclosed, for example, in the earlier-noted U.S. Pat. No. 4,159,678. The spring member 8 is hold in its position by means of a securing ring 9 seated in a circumferential groove provided on the exterior of the case bottom dome 5.

The case bottom base 3 has, on its side oriented towards the case bottom dome 5, an annular groove 10 into which extends the collar 7 of the case bottom dome 5 in such a manner that the surface of the case bottom base 3 adjoining laterally the collar 7 is flush with the upper surface of the collar 7. Further, in the transitional region between the collar 7 and the case bottom base 3 the case sleeve 2 is free from kink zones.

The primer-receiving socket 4 in the case bottom dome 5 is provided with a right-hand thread 11 for threadedly receiving a non-illustrated primer.

Further, in the case bottom dome 5 at least two fixing bores 12, 13 are provided which extend radially outwardly from the socket 4 and in which a non-illustrated holding tool may be introduced for holding the case bottom dome 5 while the case bottom base 3 is removed from or connected to the case bottom dome 5.

For removing the cases bottom base 3 from a completed cartridge, first the non-illustrated propellant primer is unscrewed from the socket 4 of the case bottom dome 5. Thereafter, with a non-illustrated holding tool which is introduced into the bores 12 and 13, the case bottom dome 5 is held firmly and the case bottom base 3 is, by rotating the same, removed from the case bottom some 5 to which the case sleeve 2 remains secured. Thereafter, a new case bottom base 3 may be screwed into the thread 6 of the case bottom dome 5 and eventually the propellant primer may be screwed into the threaded socket 4.

It is to be understood that the invention is not limited to the described embodiment. Thus, for example, the case sleeve 2 may be a multi-part component which has a shell-like stiffened portion in the region of the case bottom.

As a result of such an arrangement, upon releasing the case bottom base from or connecting it to the case bottom dome, damaging of the sleeve body is safely avoided.

It will be understood that the above description of the present invention is susceptible to various modifications, changes and adaptations, and the same are intended to be comprehended within the meaning and range of equivalents of the appended claims.

What is claimed is:

1. A propellant case comprising (a) a case sleeve having a longitudinal axis;

(b) a case bottom including (1) a case bottom base; and (2) an axially extending case bottom dome including a socket for supporting a primer therein;

(c) first connecting means for releasably attaching said case bottom base to said case bottom dome;

(d) second connecting means for permanently attaching said case bottom dome to said case sleeve, whereby upon removing said case bottom from said case bottom dome, a connection between said case bottom dome and said case sleeve is preserved; and (e) tool-receiving means provided in said case bottom dome for accommodating a tool to hold said case bottom dome during connection of said case bottom base to and removal thereof from said case bottom dome; said tool-receiving means comprising bore holes extending radially outwardly from said socket.

2. The propellant case a defined in claim 1, wherein said first connecting means comprises a screw connection.

3. A propellant case comprising (a) a case sleeve having a longitudinal axis;

(b) a case bottom including (1) a case bottom base; and (2) an axially extending case bottom dome including (i) a socket for supporting a primer therein; and (ii) a laterally projecting collar;

(c) first connecting means for releasably attaching said case bottom base to said case bottom dome;

(d) second connecting means for permanently attaching said case bottom dome to said case sleeve, whereby upon removing said case bottom from said case bottom dome, a connection between said case bottom dome and said case sleeve is preserved; and (e) a spring holding said case sleeve against said collar and securing means for supporting said spring on said case bottom dome.

4. The propellant case as defined in claim 3, wherein said securing means comprises a securing ring held in said case bottom dome and engaging said flat spring.

5. The propellant case as defined in claim 3, wherein said case bottom base is provided with a recess oriented toward said case bottom dome and accommodating said collar; said case bottom base having an outwardly oriented surface adjoining said recess; said collar having a radial surface oriented outwardly from said case bottom base; said outwardly oriented surface of said case bottom base and said radial surface of said collar being in a flush, adjoining relationship.

* * * * *